US011238775B1

(12) United States Patent
Li et al.

(10) Patent No.: US 11,238,775 B1
(45) Date of Patent: Feb. 1, 2022

(54) IMAGE ADJUSTMENT DEVICE AND IMAGE ADJUSTMENT METHOD SUITABLE FOR LIGHT-EMITTING DIODE DISPLAY

(71) Applicant: Novatek Microelectronics Corp., Hsinchu (TW)

(72) Inventors: Li Li, Shaanxi (CN); JianHua Liang, ShaanXi (CN); Hongchun Cong, ShaanXi (CN)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/126,059

(22) Filed: Dec. 18, 2020

(51) Int. Cl.
*G09G 3/20* (2006.01)
*G09G 3/3208* (2016.01)

(52) U.S. Cl.
CPC ..... *G09G 3/2074* (2013.01); *G09G 3/3208* (2013.01); *G09G 2320/0626* (2013.01); *G09G 2320/08* (2013.01); *G09G 2330/021* (2013.01); *G09G 2360/16* (2013.01)

(58) Field of Classification Search
CPC ..... G09G 3/2074; G09G 2320/0626; G09G 2330/021
See application file for complete search history.

(56) References Cited

U.S. PATENT DOCUMENTS 7,139,008 B2 * 11/2006 Mori ..... G09G 3/3233 345/690
8,184,088 B2 * 5/2012 Nonaka ..... G09G 3/3426 345/102
8,358,307 B2 * 1/2013 Shiomi ..... G06T 3/40 345/428
8,605,111 B2 * 12/2013 Moon ..... H04N 9/3182 345/600
8,660,379 B2 * 2/2014 Takamura ..... G06T 5/40 382/274
9,171,215 B2 * 10/2015 Kanou ..... H04N 5/2355
9,230,487 B2 * 1/2016 Gotoh ..... G09G 3/2007
9,666,116 B2 * 5/2017 Jung ..... G09G 3/2003
10,748,317 B2 * 8/2020 Park ..... G06T 7/90
10,777,152 B2 * 9/2020 Kang ..... G09G 3/2003
10,832,625 B2 * 11/2020 Wang ..... G09G 3/3607
10,957,282 B2 * 3/2021 Hei ..... G09G 3/3208

* cited by examiner

*Primary Examiner* — Gene W Lee
(74) *Attorney, Agent, or Firm* — JCIPRNET

(57) ABSTRACT

An image adjustment method comprises: generate a grayscale value of a target pixel by weighted averaging a plurality of input sub-pixel data of the target pixel; calculate an average of grayscale values of all pixels comprising the target pixel in a first window to generate a foreground value of the target pixel; calculate an average of grayscale values of all pixels comprising the target pixel in a second window to generate a background value of the target pixel; according to the foreground value of the target pixel and the background value of the target pixel, obtain a just-noticeable difference value in a look-up table as a grayscale difference value; generate an adjusted grayscale value of the target pixel according to the grayscale difference value; and generate a plurality of output sub-pixel data according to the plurality of input sub-pixel data of the target pixel and the adjusted grayscale value.

14 Claims, 6 Drawing Sheets

IMAGE ADJUSTMENT DEVICE AND IMAGE ADJUSTMENT METHOD SUITABLE FOR LIGHT-EMITTING DIODE DISPLAY

BACKGROUND

Technical Field

The invention relates to an image adjustment device and an image adjustment method, and more particularly, to an image adjustment device and an image adjustment method that can automatically regulate the brightness of an input image.

Description of Related Art

The light-emitting principle of an OLED (Organic Light-Emitting Diode) display is Electroluminescence, which is to use voltage to excite materials to emit light. Accordingly, in terms of power saving, the method adopted by the OLED display is completely different from the method adopted by a LCD (Liquid-Crystal Display) display that uses a backlight module to emit light. However, the existing method for power saving of the OLED display does not take visual quality into consideration. In other words, visual quality of the OLED display is reduced after power saving. Moreover, the degree of visual quality reduced is noticeable.

Therefore, it is necessary to propose a solution for the OLED display to strike a balance between energy saving and visual quality.

SUMMARY

The invention provides an image adjustment device and an image adjustment method, which can take into account energy saving and visual quality of an adjusted image.

The image adjustment method of the invention includes: generating a grayscale value of a target pixel by weighted averaging a plurality of input sub-pixel data of the target pixel; calculating an average of grayscale values of all pixels including the target pixel in a first window to generate a foreground value of the target pixel; calculating an average of grayscale values of all pixels including the target pixel in a second window to generate a background value of the target pixel, wherein a scope of the second window is larger than a scope of the first window and covers the scope of the first window; according to the foreground value of the target pixel and the background value of the target pixel, obtaining a just-noticeable difference value in a look-up table recording a plurality of just-noticeable difference values as a grayscale difference value, wherein the grayscale difference value indicates a grayscale threshold value at which a change in the grayscale value of the target pixel becomes noticeable; generating an adjusted grayscale value of the target pixel according to the grayscale difference value; and generating a plurality of output sub-pixel data according to the plurality of input sub-pixel data of the target pixel and the adjusted grayscale value.

The image adjustment device of the invention includes a grayscale conversion circuit, a grayscale difference value calculation circuit, an output grayscale calculation circuit and a sub-pixel data adjustment circuit. The grayscale conversion circuit is configured to generate a grayscale value of a target pixel by weighted averaging a plurality of input sub-pixel data of the target pixel. The grayscale difference value calculation circuit is configured to calculate an average of grayscale values of all pixels including the target pixel in a first window to generate a foreground value of the target pixel. The grayscale difference value calculation circuit is further configured to calculate an average of grayscale values of all pixels including the target pixel in a second window to generate a background value of the target pixel. A scope of the second window is larger than a scope of the first window and covers the scope of the first window. According to the foreground value of the target pixel and the background value of the target pixel, the grayscale difference value calculation circuit is further configured to obtain a just-noticeable difference value in a look-up table recording a plurality of just-noticeable difference values as a grayscale difference value. The grayscale difference value indicates a grayscale threshold value at which a change in the grayscale value of the target pixel becomes noticeable. The output grayscale calculation circuit is configured to generate an adjusted grayscale value of the target pixel according to the grayscale difference value. The sub-pixel data adjustment circuit is configured to generate a plurality of output sub-pixel data according to the plurality of input sub-pixel data of the target pixel and the adjusted grayscale value.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
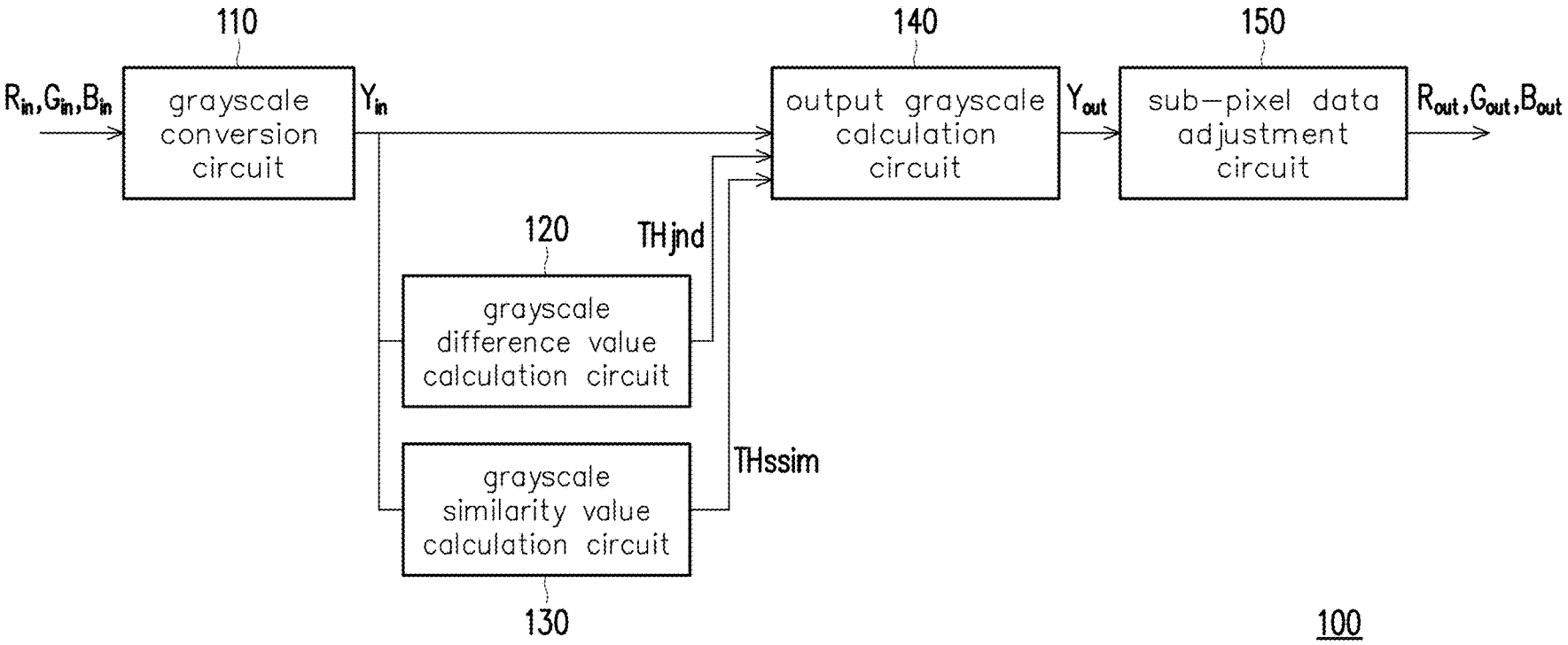
FIG. 1 shows a block diagram of a circuit structure of the image adjustment device of the invention.

FIG. 1 shows a block diagram of a circuit structure of the image adjustment device of the invention. Referring to FIG. 1, the image adjustment device 100 is suitable for the LED display, especially the OLED display, and includes a grayscale conversion circuit 110, a grayscale difference value calculation circuit 120, a grayscale similarity value calculation circuit 130, an output grayscale calculation circuit 140 and a sub-pixel data adjustment circuit 150. The grayscale conversion circuit 110 is configured to obtain a grayscale value $Y_{in}$ of a target pixel through a calculation based on a plurality of input sub-pixel data of the target pixel (e.g., a red input sub-pixel data $R_{in}$, a green input sub-pixel data $G_{in}$ and a blue input sub-pixel data $B_{in}$). After the grayscale value $Y_{in}$ of the target pixel is calculated by the grayscale difference value calculation circuit 120, a grayscale difference value $TH_{jnd}$ may be obtained. The grayscale difference value $TH_{jnd}$ is associated with a grayscale threshold value at which the user will notice a visual difference in the process of reducing the grayscale value of the target pixel. After the grayscale value $Y_{in}$ of the target pixel is calculated by the grayscale similarity value calculation circuit 130, a second grayscale difference value $TH_{ssim}$ may be obtained. The grayscale similarity value $TH_{ssim}$ is associated with an optimal brightness dropping ratio. Here, the optimal brightness reduction ratio is obtained by considering a structural similarity index (SSIM index) value and a power saving degree. The output grayscale calculation circuit 140 determines an adjusted grayscale value $Y_{out}$ of the target pixel according to the grayscale value $Y_{in}$ of the target pixel, the grayscale difference value $TH_{jnd}$ and the grayscale similarity value $TH_{ssim}$. The sub-pixel data adjustment circuit 150 is configured to generate a plurality of output sub-pixel data by adjusting the plurality of input sub-pixel data of the target pixel according to the adjusted grayscale value $Y_{out}$.

It is common knowledge that a brightness dropping degree of an input image is positively correlated with an energy saving (power saving) degree. However, when the brightness dropping degree of the input image becomes larger, the structural similarity index value between an output image and the input image becomes smaller and visual quality of the output image becomes worse. The image adjustment device 100 of the invention can make a trade-off between the grayscale difference value $TH_{jnd}$ and the grayscale similarity value $TH_{ssim}$, and thereby determine the brightness dropping degree of the input image. Output pixels are obtained by sequentially performing the above adjustment on each pixel of the input image. In this way, the invention can take into account both energy saving and visual quality of the output image. The function of each circuit will be described below.

The grayscale conversion circuit 110 is configured to receive a plurality of input sub-pixel data $R_{in}$, $G_{in}$ and $B_{in}$ of the target pixel. The grayscale conversion circuit 110 is configured to calculate the grayscale value $Y_{in}$ of the target pixel according to the plurality of input sub-pixel data $R_{in}$, $G_{in}$ and $B_{in}$. For instance, the grayscale value $Y_{in}$ of the target pixel may be obtained by Formula (1), in which $R_{coef}$, $G_{coef}$ and $B_{coef}$ are coefficients respectively. $R_{coef}$, $G_{coef}$ and $B_{coef}$ can be the same and they add up to 1. In this embodiment, $R_{coef}$, $G_{coef}$ and $B_{coef}$ are all 0.33 (i.e., ⅓). However, the invention is not limited in this regard. $B_{coef}$, $G_{coef}$ and $B_{coef}$ may also be different from each other, and they add up to 1. In another embodiment, $R_{coef}$ may be 0.2, $G_{coef}$ may be 0.7, and $B_{coef}$ may be 0.1. In other words, the grayscale conversion circuit 110 can calculate a weighted mean and an arithmetic mean of the plurality of input sub-pixel data of the target pixel to obtain the grayscale value $Y_{in}$ of the target pixel.

$$Y_{in}=R_{coef}\times R_{in}+G_{coef}\times G_{in}+B_{coef}\times B_{in} \quad \text{Formula (1)}$$

The grayscale value $Y_{in}$ of the target pixel obtained through the calculation is transmitted to the grayscale difference value calculation circuit 120, the grayscale similarity value calculation circuit 130 and the output grayscale calculation circuit 140 as inputs. The grayscale difference value calculation circuit 120 operates based on a look-up table established in advance. The look-up table includes a plurality of foreground values, a plurality of background grayscale values and a plurality of just-noticeable difference values corresponding thereto.

Figure 2A:
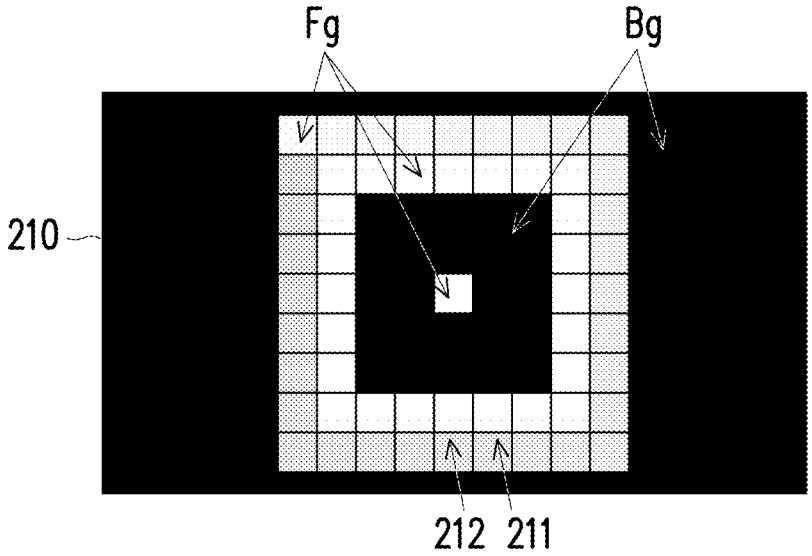
FIG. 2A shows a schematic diagram of a subjective experiment performed on the LED display to obtain the just-noticeable difference values.
Figure 2B:
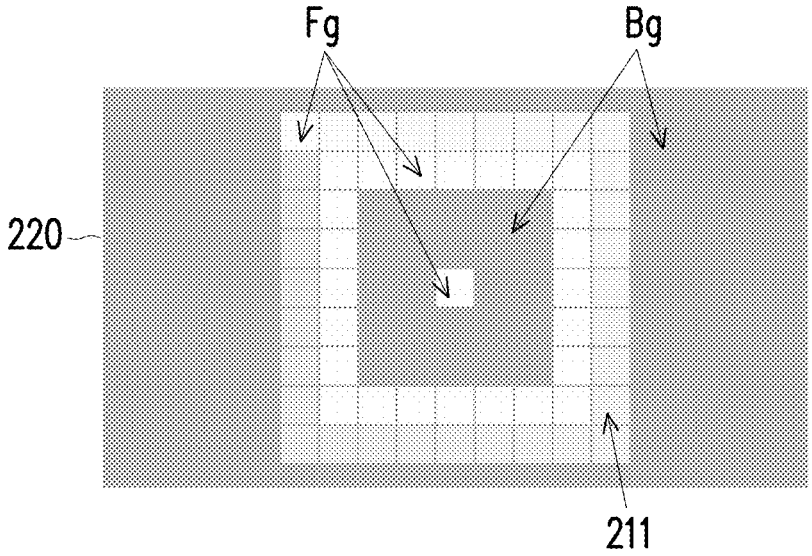
FIG. 2B shows a schematic diagram of a subjective experiment performed on the LED display to obtain the just-noticeable difference values.

FIGS. 2A and 2B are schematic diagrams of the subjective experiments performed on the LED display to obtain the just-noticeable difference values. The subjective experiments are performed with a PQ setting of the LED display (especially the OLED display) turned off. Referring to FIG. 2A, to make it easier for the subject to recognize the just-noticeable difference values, the LED display shows a specific pattern. In an image 210, a middle block, all blocks in an inner circle, and a block in the upper left corner of an outer circle are all displayed as a specific foreground value Fg, and a background color is displayed as a specific background grayscale value Bg. It is worth mentioning that, starting from the block in the upper left corner of the outer circle, the grayscale values are reduced block by block in a clockwise direction. Assuming that the block in the upper left corner of the outer circle (the foreground value Fg) is 32, the grayscale values of the blocks in the clockwise direction are 31, 30, 29, . . . , and 1 in sequence. The subject can visually compare the blocks of the inner ring and the outer ring to find out a block of the outer ring that has the smallest just-noticeable difference value with the inner ring (e.g., a block 212). Obviously, the visual difference between a block 211 and the inner circle is not noticeable. However, starting from the block 212, the visual difference between the outer circle and the inner circle cannot be ignored and increases block by block. Through such an experiment, it is possible to find out the just-noticeable difference value (i.e., the grayscale value of the block 212) corresponding to the current foreground value Fg and the background grayscale value Bg.

Referring to FIG. 2B, in an image 220, the foreground value Fg of is still 32, but the background grayscale value Bg is larger than the background grayscale value Bg of FIG. 2A. Therefore, the block of the outer ring having the smallest just-noticeable difference value with the inner ring found by the subject is a block 221. It can be seen from FIGS. 2A and 2B that even if the foreground value Fg remains the same, the just-noticeable difference value that the subject can perceive will vary with the background grayscale value Bg. In this embodiment, 9 segment points can be taken from 0 to 255 (i.e., the grayscale values are: 0, 31, 63, 95, 127, 159, 191, 223 and 255) as the foreground values and the background grayscale values. According the aforementioned method, 81 just-noticeable difference values can be obtained. That is to say, the look-up table may include 9 foreground values, 9 background grayscale values, and 81 corresponding just-noticeable difference values.

Figure 3:
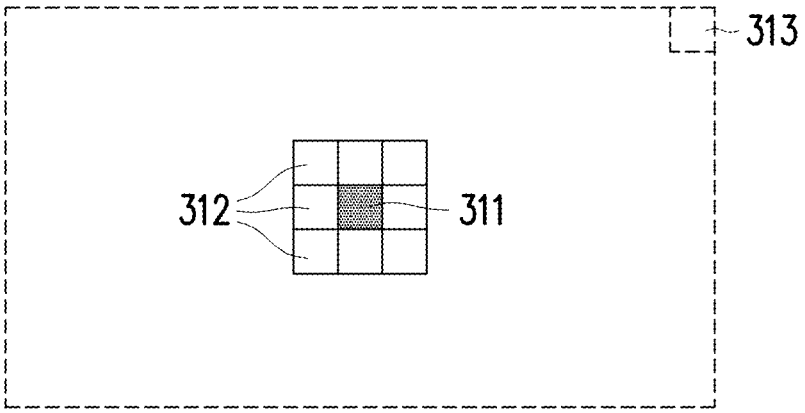
FIG. 3 shows a schematic diagram for obtaining a foreground value and a background grayscale value.

Referring back to FIG. 1, the grayscale difference value calculation circuit 120 is configured to calculate the corresponding foreground value and the background grayscale value according to the grayscale value $Y_{in}$ of the target pixel, and obtain the just-noticeable difference value based on the look-up table. FIG. 3 shows a schematic diagram for obtaining a foreground value and a background grayscale value. Referring to FIG. 1 and FIG. 3 together, the grayscale difference value calculation circuit 120 can calculate an average of the grayscale value $Y_{in}$ of a target pixel 311 and grayscale values of a plurality of adjacent pixels 312, and use the calculation result as the foreground value of the target pixel 311. The grayscale difference value calculation circuit 120 can also calculate an average of the grayscale value $Y_{in}$ of the target pixel 311 and a plurality of adjacent pixels 313 and use the calculation result as the background grayscale value of the target pixel 311. In other words, an average grayscale value of all pixels in a first window that extends outward with the target pixel 311 as the center can be used as the foreground value, and an average grayscale value of all pixels in a second window that expands outward further from the target pixel 311 can be used as the background grayscale value. In this embodiment, a scope of the second window can cover all pixels of the input image. However, the invention is not limited in this regard. The size of the first window and the second window can be designed. In another embodiment, the number of pixels covered by the first window may also be 4, and the target pixel is one of them.

According to the foreground value and the background grayscale value of the target pixel, the grayscale difference value calculation circuit 120 finds the corresponding just-noticeable difference value from the look-up table as the grayscale difference value $TH_{jnd}$. If the foreground value/background grayscale value of the target pixel cannot accurately correspond to one of the 9 foreground values/background grayscale values described above, the grayscale difference value calculation circuit 120 may obtain the grayscale difference value $TH_{jnd}$ by performing an interpolation operation. Specifically, if the calculated foreground value and the background value of the target pixel are between two segment points (e.g., the foreground value is 45 (between 31 and 63) and the background grayscale value is 165 (between 159 and 191), the grayscale difference value $TH_{jnd}$ of this target pixel can be obtained by performing the interpolation operation on the just-noticeable difference values found by searching the look-up table. In other embodiments, the foreground value and the background grayscale value may be downsampled (e.g., 8 bit (which can represent 0 to 255) may be downsampled to 3 bit), and obtain the grayscale difference value $TH_{jnd}$ according to the segment point corresponding the downsampled result.

The grayscale similarity value calculation circuit 130 can calculate the grayscale similarity value $TH_{ssim}$ according to the grayscale value $Y_{in}$ of the target pixel and an optimal brightness dropping ratio $opt(p_r)$. The optimal brightness dropping ratio $opt(p_r)$ may be obtained through Formula (2), in which $Yin_k$ represents the grayscale value of one pixel in the first window and N is the number of pixels of the OLED display. powerMax represents a maximum power consumption value when the intensity of all pixels reaches the maximum. Both N and powerMax may be obtained in advance.

$$opt(p_r) = \sqrt{\frac{1}{1 + 2\frac{\sum_{k=1}^{N} (Yin_k)^2}{powerMax}}} \quad \text{Formula (2)}$$

Figure 4:
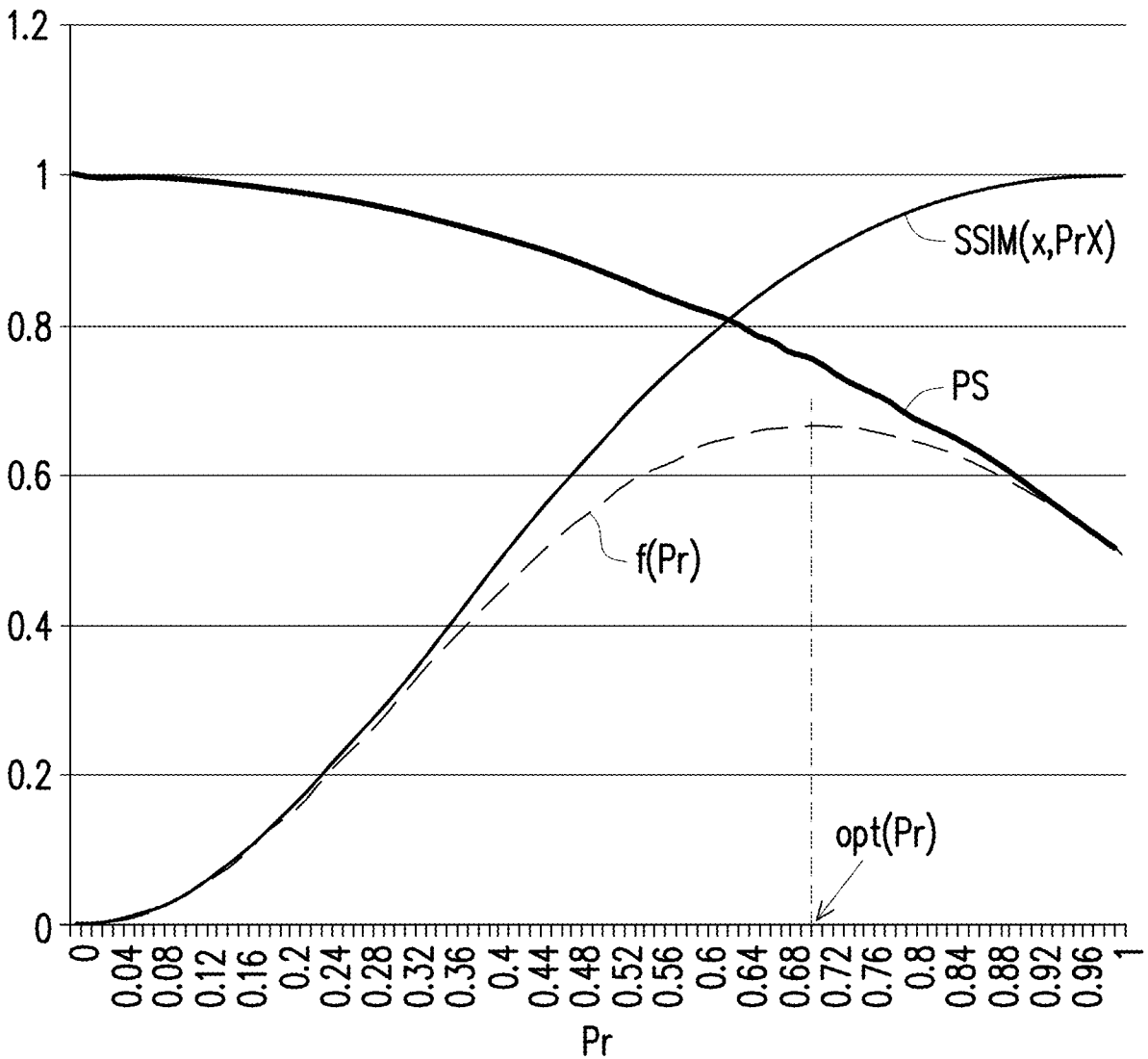
FIG. 4 is a curve diagram showing changes in a structural similarity index value and a power saving degree with respect to a brightness dropping ratio.

The meaning of the optimal brightness dropping ratio $opt(p_r)$ can be seen in FIG. 4. FIG. 4 is a curve diagram showing changes in a structural similarity index value and a power saving degree with respect to a brightness dropping ratio. A brightness dropping ratio $p_r$ has a maximum value of 1 and a minimum value of 0. When a value of the brightness dropping ratio $p_r$ is smaller, the brightness dropping degree is larger. Conversely, when the value of the brightness dropping ratio $p_r$ is greater, the brightness dropping degree is smaller. A structural similarity index value SSIM is an index for measuring a similarity degree between an undistorted image and a distorted image that can be used to evaluate an image quality of the distorted image. Compared with traditional image quality measurement indexes (e.g., Peak signal-to-noise ratio (PSNR)), the structural similarity index value SSIM is more in line with the judgment of the human eye on the image quality in the measurement of image quality. It can be seen from FIG. 4 that, the structural similarity index value SSIM is positively correlated with the brightness dropping ratio $p_r$, and a power saving degree PS is negatively correlated with the structural similarity index value $p_r$. In other words, the power saving degree PS and the structural similarity index value SSIM have opposite trends.

The power saving degree PS may be obtained through Formula (3). $p_r$ is the brightness dropping ratio, and $Y_{in}$ represents the grayscale value of the target pixel. N is the number of pixels in the first window. powerMax represents a maximum power consumption value when the intensity of all pixels reaches the maximum. N and powerMax are fixed values that can be obtained in advance. FIG. 4 shows how the power saving degree PS changes with the brightness dropping ratio $p_r$.

$$PS = 1 - \frac{\sum_{k=1}^{N} (p_r Yin_k)^2}{powerMax} \quad \text{Formula (3)}$$

Incidentally, a power consumption p caused by one single pixel may be calculated through Formula (4). In Formula (4), R, R and B represent pixel values of a red sub-pixel, a green sub-pixel and a blue sub-pixel, respectively. $\gamma$ is associated with a gamma correction of the red sub-pixel, the green sub-pixel and the blue sub-pixel, and is generally 2.2. $w_0$ represents a static power consumption not related to pixel content being considered. $w_r$, $w_g$ and $w_b$ are weighting coefficients that express different characteristics of the red sub-pixel, the green sub-pixel and the blue sub-pixel, respectively. For the purpose of simplification, $\gamma$ may be set to 2 to employ a quadratic power model. More importantly, in order to simplify the calculation, the grayscale value $Y_{in}$ of the target pixel obtained through Formula (1) can be used to represent R, G and B in Formula (4). A power consumption P of N pixels may be obtained through Formula (5). N is the number of pixels of the OLED display. $W_0$ represents that a static power consumption of the whole OLED display panel. In addition, the power consumption $P_0$ after power saving can be calculated through Formula (6) after power saving, in which $p_r$ is the brightness dropping ratio. To normalize the power saving degree to a value between 0 and 1, Formula (3) may be used represent the power saving degree PS. It can be seen from FIG. 4 that the power saving degree PS has a maximum value of 1 and a minimum value of 0.

$$p = w_0 + w_r R^\gamma + w_g G^\gamma + w_b B^\gamma \quad \text{Formula (4)}$$

$$P = W_0 + \Sigma_{k=1}^{N} Yin_k^2 \quad \text{Formula (5)}$$

$$P_0 = W_0 + \Sigma_{k=1}^{N} (p_r Yin_k)^2 \quad \text{Formula (6)}$$

The structural similarity index value SSIM(x, y) between x and y may be obtained through Formula (7). x and y are from two images respectively. The two images can be regarded as the original image accepted by the grayscale conversion circuit 110 and the image after power saving, referred to as a first image and a second image. x is a subset of the pixel that can be obtained by a sliding the first window in the first image. y is a subset of the pixel that can be obtained by a sliding window in the second image. It should be noted that the concepts of the first window mentioned earlier and sliding window are similar. The first window can be regarded as the current sliding window, and the target pixel may be a pixel located in the center of the current sliding window. Through the sliding window, a subset of pixels at the same position in the two images can be circled out to become x and y respectively. Specifically, x represents an original pixel in the first window, and y represents an adjusted pixel in the first window adjusted by the brightness dropping ratio $p_r$. $\mu_x$ and $\mu_y$ are means of x and y respectively. $\sigma_x^2$ and $\sigma_y^2$ are variances of x and y respectively. The calculation object of the mean and variance is the grayscale value $Y_{in}$ of each pixel in the sliding window. $\sigma_{xy}$ is a covariance of x and y. Constants $c_1$ and $c_2$ are added to avoid 0/0 division. Since $c_1$ and $c_2$ are introduced for stabilization of formula, their chosen value has negligible impact on a SSIM measure. $c_1$ and $c_2$ may be removed to simplify calculation. Formula (7) can be simplified to formula (8), in which y is expressed as $p_r x$ and $p_r$ represents the brightness dropping ratio. In view of Formula (8), how the structural similarity index value SSIM(x, $p_r$x) changes with the brightness dropping ratio $p_r$ is as shown by FIG. 4. It can be seen from FIG. 4 that the structural similarity index value SSIM (x, $p_r$x) has a maximum value of 1 and a minimum value of 0.

$$SSIM(x, y) = \frac{(2\mu_x\mu_y + c_1)(2\sigma_{xy} + c_2)}{(\mu_x^2 + \mu_y^2 + c_1)(\sigma_x^2 + \sigma_y^2 + c_2)} \quad \text{Formula (7)}$$

$$SSIM(x, p_r x) \approx \frac{(2p_r\mu_x^2)(2p_r\sigma_x^2)}{[(1+p_r^2)\mu_x^2][(1+p_r^2)\sigma_x^2]} = \frac{4p_r^2}{(1+p_r^2)^2} \quad \text{Formula (8)}$$

Next, a function $f(p_r)$ shown by Formula (9) may be designed. Parameters of the function $f(p_r)$ are simplified structural similarity index valueSSIM(x, $p_r$x) (Formula (8)) and the power saving degree PS (Formula (3)). Values of the function $f(p_r)$ are shown in FIG. 4. Referring to FIG. 4, the function $f(p_r)$ has one peak value. A value of $p_r$ corresponding to the peak value of the function $f(p_r)$ is the optimal brightness dropping ratio opt($p_r$), which is regarded as the result obtained after balancing the power saving degree and an image structural similarity. The optimal brightness dropping ratio opt($p_r$) may be obtained through Formula (2). It is worth mentioning that, the calculation of the optimal brightness dropping ratio opt($p_r$) is performed in a local window size, and thus N in Formula (2) is the number of pixels of the OLED display. After the optimal brightness dropping ratio opt($p_r$) is obtained, the grayscale similarity value calculation circuit 130 further performs a calculation based on Formula (10) to obtain the grayscale similarity value $TH_{ssim}$.

$$f(p_r) = \left(1 - \frac{\sum_{k=1}^{N} (p_r Yin_k)^2}{powerMax}\right) \times \frac{4p_r^2}{(1+p_r^2)^2} \quad \text{Formula (9)}$$

$$TH_{ssim} = Y_{in}(1 - \text{opt}(p_r)) \quad \text{Formula (10)}$$

Figure 5:
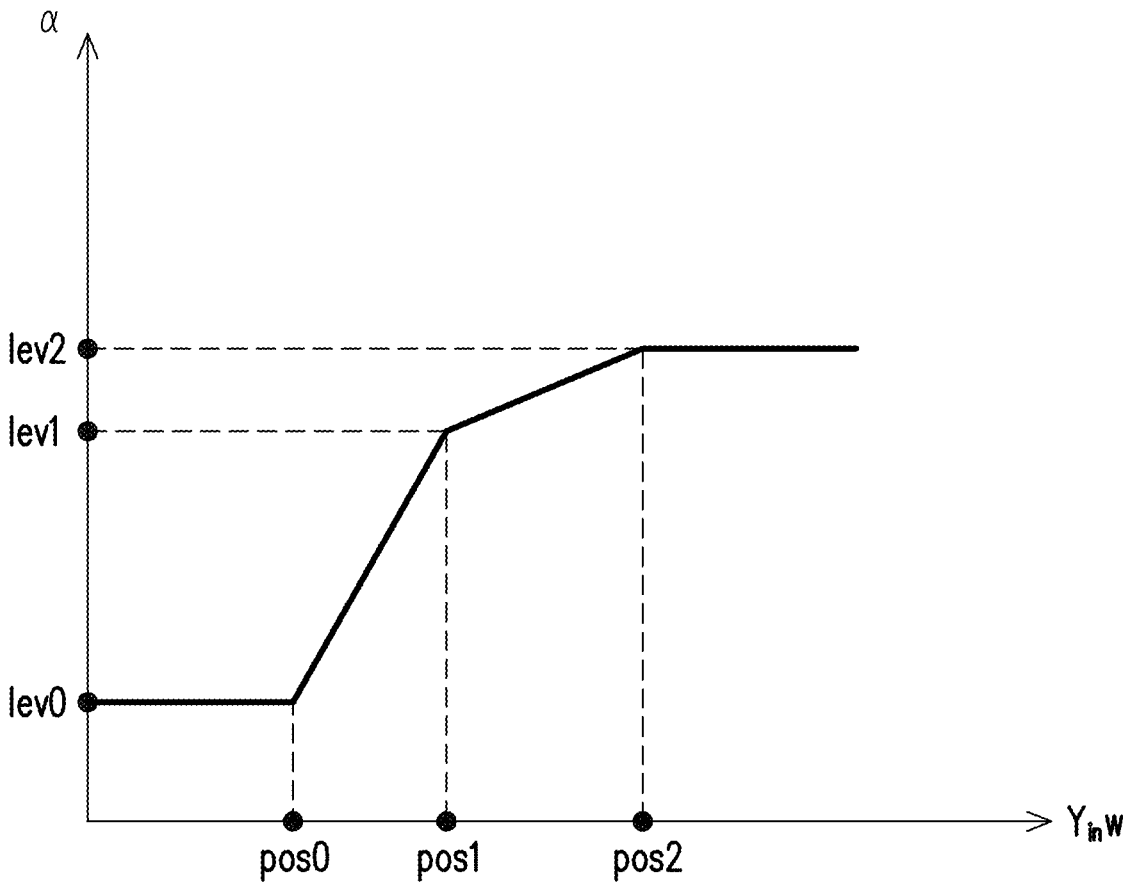
FIG. 5 shows a schematic diagram of curve mapping.

The output grayscale calculation circuit 140 can perform a weighted average operation on the grayscale difference value and the grayscale similarity value based on Formula (11) to obtain a third grayscale value $TH_{final}$. A coefficient $\alpha$ in Formula (11) may be obtained by curve mapping shown by FIG. 5. FIG. 5 shows a schematic diagram of curve mapping. Referring to FIG. 5, the x-axis represents an average of the grayscale values of all pixels in the first window (equivalent to the foreground value) denoted by $Y_{in}$w. y-axis represents the coefficient $\alpha$. Values pos0, pos1, pos2, lev0, lev1 and lev2 may be adjusted arbitrarily according to requirements. Based on FIG. 5, the corresponding coefficient $\alpha$ may be found according to the average of the grayscale values of all pixels in the first window. Next, the output grayscale calculation circuit 140 can obtain the third grayscale value $TH_{final}$ of the target pixel based on Formula (11). The output grayscale calculation circuit 140 inputs the third grayscale value $TH_{final}$ to Formula (12) for calculation to generate the adjusted grayscale value $Y_{out}$. Formula (12) is used to obtain the larger one of the two data in the bracket to avoid the adjusted grayscale value $Y_{out}$ from being a negative value.

$$TH_{final} = \alpha \times TH_{ssim} + (1-\alpha) \times TH_{jnd} \quad \text{Formula (11)}$$

$$Y_{out} = \max(Y_{in} - TH_{final}, 0) \quad \text{Formula (12)}$$

The function of the sub-pixel data adjustment circuit 150 is to maintain the same saturation and hue between the output sub-pixel data and the input sub-pixel data. According to Formula (13), the sub-pixel data adjustment circuit 150 multiplies the input sub-pixel signals $R_{in}$, $G_{in}$ and $B_{in}$ by the same ratio to generate output sub-pixel signals $R_{out}$, $G_{out}$ and $B_{out}$. A very small constant T is set to avoid 0 divided by 0.

$$\begin{cases} R_{out} = \dfrac{Y_{out}}{Y_{in} + \tau} \times R_{in} \\ G_{out} = \dfrac{Y_{out}}{Y_{in} + \tau} \times G_{in} \\ B_{out} = \dfrac{Y_{out}}{Y_{in} + \tau} \times B_{in} \end{cases} \quad \text{Formula (13)}$$

In terms of hardware, the grayscale conversion circuit 110, the grayscale difference value calculation circuit 120, the grayscale similarity value calculation circuit 130, the output grayscale calculation circuit 140 and the sub-pixel data adjustment circuit 150 may be implemented by logic circuits on an integrated circuit. The related functions of the circuits described above may be implemented as hardware using hardware description languages (e.g., Verilog HDL or VHDL) or other suitable programming languages. For instance, the related functions of the circuits described above may be implemented as various logic blocks, modules and circuits in one or more controllers, microcontrollers, microprocessors, application-specific integrated circuits (ASIC), digital signal processors (DSP), field programmable gate arrays (FPGA) and/or other processing units.

Figure 6:
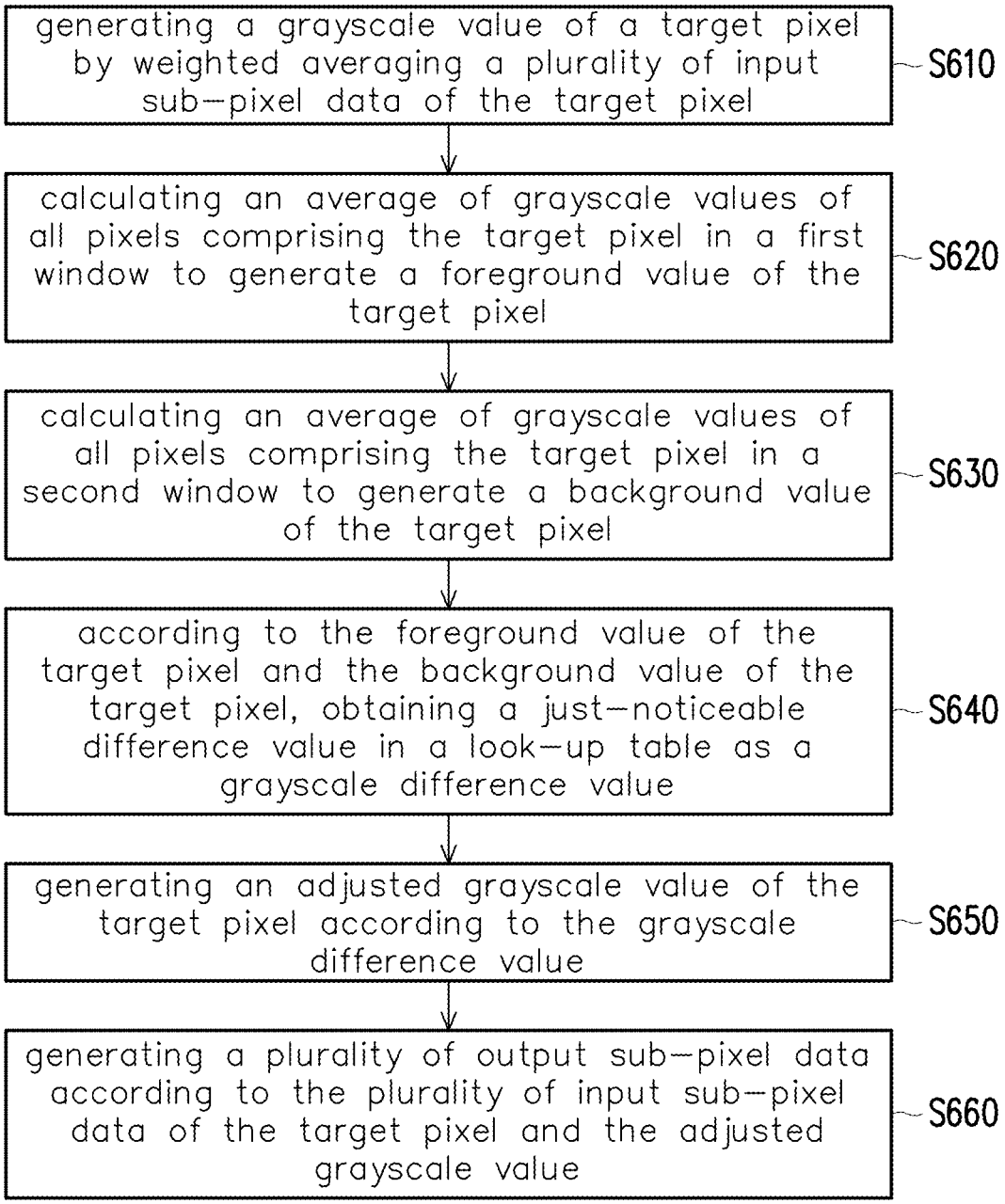
FIG. 6 is a flowchart showing steps of the image adjustment method of the invention.

FIG. 6 is a flowchart showing steps of the image adjustment method of the invention. Referring to FIG. 6, first of all, a grayscale value of a target pixel is generated by weighted averaging a plurality of input sub-pixel data of the target pixel (step S610). Next, an average of grayscale values of all pixels including the target pixel in a first window is calculated to generate a foreground value of the target pixel (step S620). Then, an average of grayscale values of all pixels including the target pixel in a second window is calculated to generate a background value of the target pixel (step S630). Here, a scope of the second window is larger than a scope of the first window and covers the scope of the first window. According to the foreground value of the target pixel and the background value of the target pixel, a just-noticeable difference value in a look-up table recording a plurality of just-noticeable difference values is obtained as a grayscale difference value (step S640). The grayscale difference value indicates a grayscale threshold value at which a change in the grayscale value of the target pixel becomes visually noticeable. An adjusted grayscale value of the target pixel is generated according to the grayscale difference value (step S650). Lastly, a plurality of output sub-pixel data are generated according to the plurality of input sub-pixel data of the target pixel and the adjusted grayscale value (step S660).

In summary, the invention can determine a brightness scaling ratio of the grayscale value of the target pixel according to the grayscale difference value $TH_{jnd}$ and the grayscale similarity value $TH_{ssim}$. The grayscale difference value $TH_{jnd}$ is a grayscale value threshold value corresponding to the grayscale value of the pixel of the target pixel reduced to show a visual difference that the user can notice. The grayscale similarity value $TH_{ssim}$ is obtained after weighing the structural similarity index and the power saving degree. The grayscale difference value $TH_{jnd}$ and the grayscale similarity value $TH_{ssim}$ are calculated separately and then blended together, and finally the adjusted grayscale value $Y_{out}$ of the target pixel can be obtained. According to the adjusted grayscale value $Y_{out}$, the output sub-pixel data of the target pixel can be adjusted. In this way, a dynamic brightness control can be performed in R/G/B channels at the same time to maintain saturation and hue. Based on the above technical means, it can be known that the invention is easy to implement and has low implementation cost, and can effectively save power while maintaining visual quality.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An image adjustment method suitable for a light-emitting diode display, comprising:

generating a grayscale value of a target pixel by weighted averaging a plurality of input sub-pixel data of the target pixel;

calculating an average of grayscale values of all pixels comprising the target pixel in a first window to generate a foreground value of the target pixel;

calculating an average of grayscale values of all pixels comprising the target pixel in a second window to generate a background value of the target pixel, wherein a scope of the second window is larger than a scope of the first window and covers the scope of the first window;

according to the foreground value of the target pixel and the background value of the target pixel, obtaining a just-noticeable difference value in a look-up table recording a plurality of just-noticeable difference values as a grayscale difference value, wherein the grayscale difference value indicates a grayscale threshold value at which a change in the grayscale value of the target pixel becomes noticeable;

generating an adjusted grayscale value of the target pixel according to the grayscale difference value; and generating a plurality of output sub-pixel data according to the plurality of input sub-pixel data of the target pixel and the adjusted grayscale value.

2. The image adjustment method as claimed in claim 1, wherein the step of generating the adjusted grayscale value of the target pixel according to the grayscale difference value further comprises:

generating the adjusted grayscale value of the target pixel according to the grayscale difference value and a grayscale similarity value which is associated with a brightness dropping ratio associated with a structural similarity.

3. The image adjustment method as claimed in claim 2, further comprising:

calculating the brightness dropping ratio of the target pixel according to the grayscale values of all pixels comprising the target pixel in the first window and a maximum power consumption value of the light-emitting diode display; and generating a grayscale similarity value according to the grayscale value of the target pixel and the brightness dropping ratio.

4. The image adjustment method as claimed in claim 3, wherein a relationship between the grayscale values of all pixels in the first window, the maximum power consumption value, and the brightness dropping ratio is:

$$p_r = \sqrt{\frac{1}{1 + 2\frac{\sum_{k=1}^{N} (Yin_k)^2}{powerMax}}},$$

wherein, Yin represents the grayscale value of the target pixel, N represents the number of pixels included in the first window, powerMax represents the maximum power consumption value, and Pr represents the brightness dropping ratio.

5. The image adjustment method as claimed in claim 4, wherein the step of generating the grayscale similarity value further comprises:

calculating a difference between 1 and the brightness dropping ratio; and calculating a product of the difference and the grayscale value of the target pixel to generate the grayscale similarity value.

6. The image adjustment method as claimed in claim 1, wherein the step of generating the adjusted grayscale value of the target pixel according to the grayscale difference value further comprises:

performing a weighted average operation on the grayscale difference value and the grayscale similarity value to generate an operation result; and comparing zero and a difference between the operation result and the grayscale value of the target pixel, and taking the larger one as the adjusted grayscale value.

7. The image adjustment method as claimed in claim 1, wherein the first window surrounds the target pixel, and the scope of the second window covers all pixels of the light-emitting diode display.

8. An image adjustment device suitable for a light-emitting diode display, comprising:

a grayscale conversion circuit, configured to generate a grayscale value of a target pixel by weighted averaging a plurality of input sub-pixel data of the target pixel;

a grayscale difference value calculation circuit, configured to:

calculate an average of grayscale values of all pixels comprising the target pixel in a first window to generate a foreground value of the target pixel;

calculate an average of grayscale values of all pixels comprising the target pixel in a second window to generate a background value of the target pixel, wherein a scope of the second window is larger than a scope of the first window and covers the scope of the first window; and according to the foreground value of the target pixel and the background value of the target pixel, obtain a just-noticeable difference value in a look-up table recording a plurality of just-noticeable difference values as a grayscale difference value, wherein the grayscale difference value indicates a grayscale threshold value at which a change in the grayscale value of the target pixel becomes noticeable;

an output grayscale calculation circuit, configured to generate an adjusted grayscale value of the target pixel according to the grayscale difference value; and a sub-pixel data adjustment circuit, configured to generate a plurality of output sub-pixel data according to the plurality of input sub-pixel data of the target pixel and the adjusted grayscale value.

9. The image adjustment device as claimed in claim 8, wherein the output grayscale calculation circuit is further configured to:

generate the adjusted grayscale value of the target pixel according to the grayscale difference value which is associated with a brightness dropping ratio associated with a structural similarity.

10. The image adjustment device as claimed in claim 9, further comprising:

a grayscale similarity value calculation circuit, configured to:

calculate the brightness dropping ratio of the target pixel according to the grayscale values of all pixels comprising the target pixel in the first window and a maximum power consumption value of the light-emitting diode display; and generate a grayscale similarity value according to the grayscale value of the target pixel and the brightness dropping ratio.

11. The image adjustment device as claimed in claim 10, wherein a relationship between the grayscale values of all pixels in the first window, the maximum power consumption value, and the brightness dropping ratio is:

$$p_r = \sqrt{\frac{1}{1 + 2\frac{\sum_{k=1}^{N} (Yin_k)^2}{powerMax}}},$$

wherein, Yin represents the grayscale value of the target pixel, N represents the number of pixels included in the first window, powerMax represents the maximum power consumption value, and Pr represents the brightness dropping ratio.

12. The image adjustment device as claimed in claim 11, wherein the grayscale similarity value calculation circuit is further configured to:

calculate a difference between 1 and the brightness dropping ratio; and calculate a product of the difference and the grayscale value of the target pixel to generate the grayscale similarity value.

13. The image adjustment device as claimed in claim 8, wherein the output grayscale calculation circuit is further configured to:

perform a weighted average operation on the grayscale difference value and the grayscale similarity value to generate an operation result; and compare zero and a difference between the operation result and the grayscale value of the target pixel, and taking the larger one as the adjusted grayscale value.

14. The image adjustment device as claimed in claim 8, wherein the first window surrounds the target pixel, and the scope of the second window covers all pixels of the light-emitting diode display.

* * * * *